US005975721A

United States Patent [19]

Wu

[11] Patent Number: 5,975,721

[45] Date of Patent: Nov. 2, 1999

[54] DRAINING STRUCTURE OF A LIGHT BULB HOLDER

[76] Inventor: Chin Lu Wu, No. 5, Lane 193, Konyuan Road, Hsinchu, Taiwan

[21] Appl. No.: 09/037,919

[22] Filed: Mar. 10, 1998

[51] Int. Cl.[6] ..... F21V 19/00

[52] U.S. Cl. ..... 362/294; 362/226; 362/806

[58] Field of Search ..... 362/123, 226, 362/249, 252, 267, 294, 806; 439/206

[56] References Cited

U.S. PATENT DOCUMENTS 5,605,395 2/1997 Peng ..... 362/226

5,707,138 1/1998 Pan ..... 362/806

5,722,766 3/1998 Shu ..... 362/249

*Primary Examiner*—Y. Quach

*Attorney, Agent, or Firm*—Rosenberg, Klein & Bilker

[57] ABSTRACT

An improved draining structure of a light bulb holder includes an inclined plate provided in the inner space of the holder. The electrical wire pre-assembled with the conductive plate is directly inserted into the light bulb holder through a triangular opening defined by the inclined plate in one technological step. The structure provides for assembling of the light bulb holder in a single technological step and provides the draining effect at the same time.

1 Claim, 3 Drawing Sheets

DRAINING STRUCTURE OF A LIGHT BULB HOLDER

BACKGROUND OF THE INVENTION

In order to prevent from a short circuit on a light string, each light bulb holder (1) of the light string is provided with a plate (11), as shown in FIG. 1 or as described in U.S. Pat. No. 5,707,138. The plate (11) is perpendicular to the opening of the holder (1) and separates the inner space into two areas and forms two small holes (12) at the end of the holder (1), as shown in FIG. 4, for draining. In order to assemble the structure with the electrical wire (3) and conductive plate (31), the electrical wire (3) is inserted through the hole (12) to engage the conductive plate (31). Then, the electrical wire (3) together with the plate (31) is pulled back into a proper position in the light bulb holder (1). The wire (3) with the plate (31) cannot be inserted into the holder (1) because the width of the plate (31) is larger than the diameter of the small hole (12) of the holder (1). Such assembling procedures of the known light bulb holder is troublesome and inconvenient.

OBJECT OF THE INVENTION

The main object of the present invention is to provide an improved draining structure of a light bulb holder having an inclined plate formed in the holder to provide a draining effect and facilitate assembly of the light bulb holder with the electrical wire, the electrical wire being pre-assembled with the conductive plate.

The detailed structure, features, and other advantages of this invention will become apparent from the following detailed description of a preferred embodiment when read with reference to the accompanying drawings.

DETAILED DESCRIPTION OF THE EMBODIMENT

Figure 1:
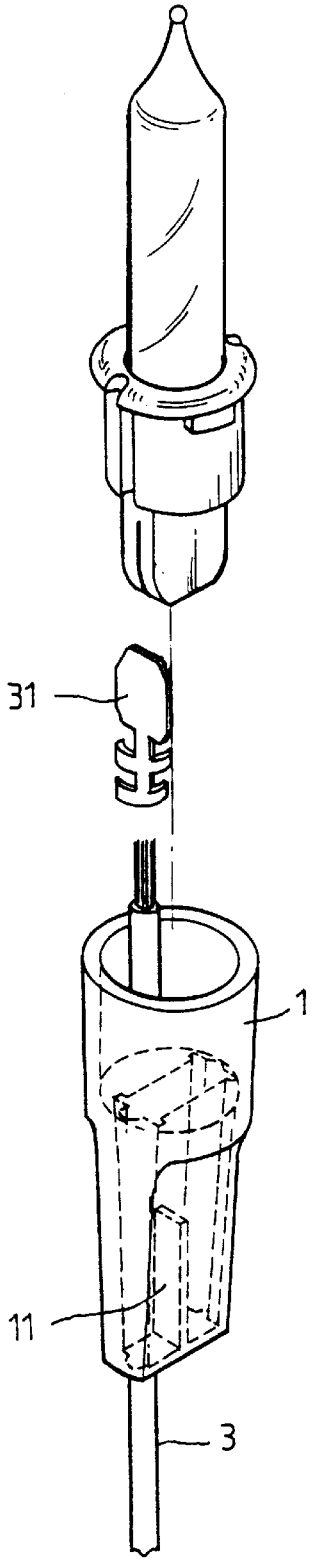
FIG. 1 (prior art)
FIG. 1 is a perspective view showing a draining structure of a prior art light bulb holder.
Figure 2:
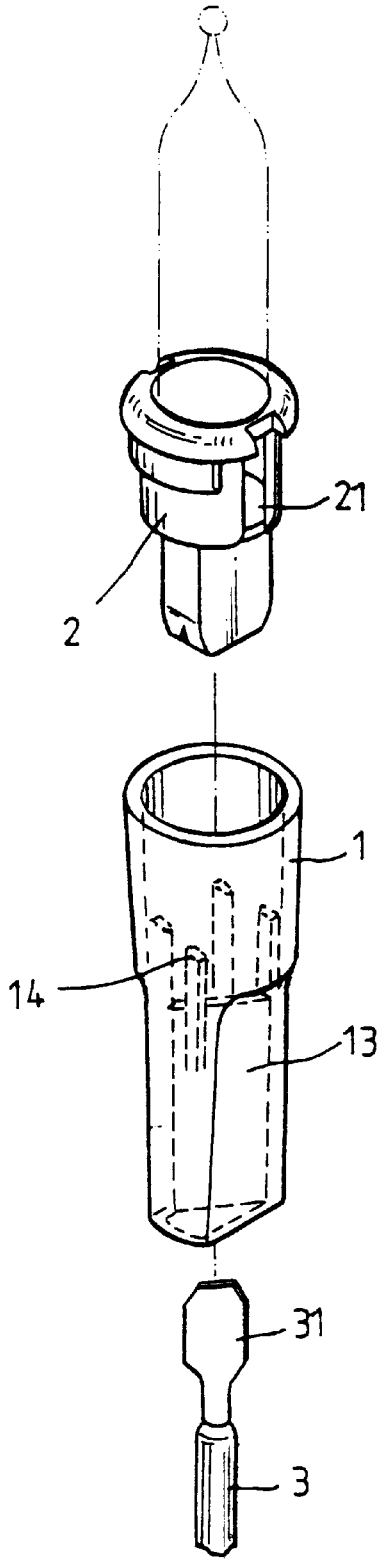
FIG. 2 is a perspective view showing the improved draining structure of a light bulb holder according to the present invention.
Figure 3:
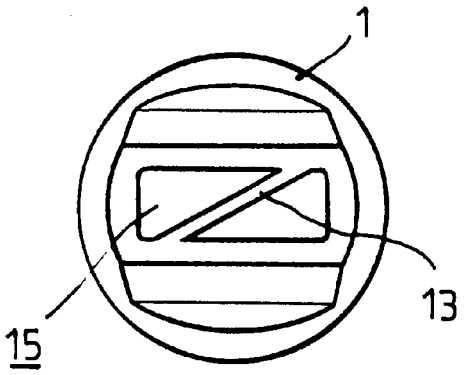
FIG. 3 is a bottom plan view of the light bulb holder of FIG. 2.
Figure 4:
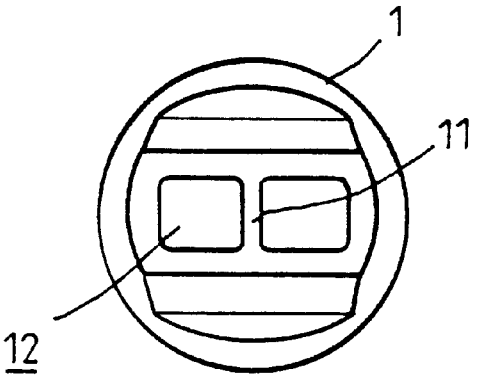
FIG. 4 (prior art)
FIG. 4 is a bottom plan view of the light bulb holder of FIG. 1.

Referring to FIGS. 2 and 3, the present invention includes a light bulb holder (1) and a light bulb connector (2), wherein an inclined plate (13) is provided in the light bulb holder (1) and a pair of guides (14) are formed in both inner sides of the holder (1) to engage with the end of the light bulb connector (2). The connector (2) is provided with two grooves (21) at two sides, each of which relates to one of the inner areas separated by the inclined plate (13).

By use of the inclined plate (13) in the light bulb holder (1) of this invention, two triangular holes (15) are formed at the opening of the holder (1), as shown in FIG. 3. Since the length of the hypotenuse of the triangular hole (15) is larger than the width of the conductive plate (31), it is possible to pre-assemble the conductive plate (31) to the electrical wire (3) and then to assemble them to the holder (1) by directly inserting them through the hole (15). The electrical wire (3) together with the conductive plate (31) are thus properly positioned in the holder (1).

Accordingly, the improved structure of the present invention is capable of providing the draining effect, where the rain drains from the grooves (21) and through two separated inner areas and the triangular holes (15). It is the most important that the inclined plate (13) forms a pair of triangular holes where each has a hypotenuse long enough to allow the electrical wire that has been pre-assembled with a conductive plate to pass through the respective triangular hole. That arrangement facilitates assembly of the light bulb holder and a string of light bulbs.

What is claimed is:

1. An improved draining structure of a light bulb holder, comprising:

(a) a light bulb connector, including:

a light bulb receiving member having a top portion and a bottom portion, said light bulb receiving member having a pair of grooves formed at opposite sides of said light bulb receiving member and extending longitudinally between said top and bottom portions thereof;

(b) a light bulb holder having walls defining a hollow upper body portion and a hollow lower body portion, said upper and lower body portions being integrally connected each to the other, said upper body having an upper opening for receiving said light bulb receiving member therein, said lower body portion having a lower opening formed therein;

a plurality of guides formed internally within said hollow upper and lower body portions and extending along said walls of said light bulb holder for receiving a portion of said light bulb receiving member therebetween, and an inclined plate disposed diagonally within said lower body portion of said light bulb holder and extending from lower edges of said walls of said light bulb holder for a length substantially equal to a length of said lower body portion, thereby dividing said lower body portion into two adjacent triangularly shaped sections and divising said lower opening into a pair of corresponding triangularly shaped openings;

(c) a pair of electrical wires and a pair of conductive plates, each conductive plate having a respective width dimension, each said electrical wire being pre-assembled with a respective one of said conductive plates on one end thereof, each of said pair of grooves being in open communication with a respective one of said two triangular sections, and said one end of each of said pair of electrical wires having a respective conductive plate secured thereon being passed through a respective one of said triangularly shaped openings when said width of said conductive plate is aligned with a hypotenuse of said triangularly shaped opening.

* * * * *